US006870939B2

(12) United States Patent
Chiang et al.

(10) Patent No.: US 6,870,939 B2
(45) Date of Patent: Mar. 22, 2005

(54) SMT-TYPE STRUCTURE OF THE SILICON-BASED ELECTRET CONDENSER MICROPHONE

(75) Inventors: Dar-Ming Chiang, Hsin-Chu (TW); Tsung-Lung Yang, Hsin-Chu (TW)

(73) Assignee: Industrial Technology Research Institute, Hsin-Chu Hsien (TW)

( * ) Notice: Subject to any disclaimer, the term of this patent is extended or adjusted under 35 U.S.C. 154(b) by 163 days.

(21) Appl. No.: 09/994,687

(22) Filed: Nov. 28, 2001

(65) Prior Publication Data

US 2003/0099368 A1 May 29, 2003

(51) Int. Cl.[7] ..... H04R 25/00

(52) U.S. Cl. ..... 381/175; 381/191; 307/400; 367/170

(58) Field of Search ..... 381/113, 116, 381/173, 174, 190, 191; 367/140, 170, 181; 29/25.41, 592.1, 594; 307/400; 310/322

(56) References Cited

U.S. PATENT DOCUMENTS 5,408,731 A * 4/1995 Berggvist et al. ..... 29/25.41
5,490,220 A * 2/1996 Loeppert ..... 381/355
5,889,872 A * 3/1999 Sooriakumar et al. ..... 381/174
6,140,689 A * 10/2000 Scheiter et al. ..... 257/414
6,243,474 B1 * 6/2001 Tai et al. ..... 381/174
6,426,239 B1 * 7/2002 Gogoi et al. ..... 438/53
6,535,460 B2 * 3/2003 Loeppert et al. ..... 367/181

FOREIGN PATENT DOCUMENTS

KR 2002081740 A * 4/2001

* cited by examiner

*Primary Examiner*—Curtis Kuntz
*Assistant Examiner*—Brian Ensey
(74) *Attorney, Agent, or Firm*—Bacon & Thomas, PLLC.

(57) ABSTRACT

This invention mainly provides a SMT-type structure of the minimized and low-power silicon-based electret condenser microphone. Primarily integrates with the electret, silicon-based, MEMS and microphone techniques to implement the minimized and low-power silicon-based electret condenser microphone. The Silicon-based bi-diaphragm of the composite diaphragm-chip was coated with the low-dielectric macromolecule material to allow the microphone acquires the sufficient electrical charges. Moreover, the impedance matching element of the microphone that MOSFET was implemented by the MEMS technology. Conclusively, this silicon-based electret condenser microphone gains several achievements as the smallest volume, a lower bias voltage, a SMT-type structure, a lower residue stress and a lower assembly cost.

19 Claims, 11 Drawing Sheets

SMT-TYPE STRUCTURE OF THE SILICON-BASED ELECTRET CONDENSER MICROPHONE

BACKGROUND OF INVENTION

1. Field of Invention

This invention mainly provides a SMT-type structure of the silicon-based electret condenser microphone. Primarily integrates the electret technology, silicon-based, MEMS and microphone to form the SMT-type silicon-based electret condenser microphone.

2. Description of the Prior Art

As the technology has made great progress nowadays, the size of mobile communication device becomes smaller and smaller indeed. Correspondingly, its whole module and the internal electronic parts must be minimized as much as possible. The traditional condenser microphone not only owns a larger dimension, but also costs a lot. It needs higher voltage bias for driving it to work with; therefore it is not satisfied with the requirement of the mobile communication device, which specifies under a lower voltage and a smaller volume. Considering the tiny mobile communication device that owns high efficiency, how to minimize the microphone becomes necessary and urgent.

The microphone is a mechanism using to transfer the sound energy into the electrical energy. Usually, there are dynamic microphone, condenser microphone, piezoelectric/piezoresistive microphone and electret condenser microphone. As far as we know, U.S. Pat. No. 5,490,220 describes a solid-state condenser microphone, which needs very high polarized-voltage input and is very sensitive to humidity. It requires a specified moisture-proof storage to keep it. Secondly, U.S. Pat. No. 5,740,261 describes a microphone structure, which needs more than 10 volts to acquire a better sensitivity, and it can't be minimized and worked with low-power usage. Furthermore, U.S. Pat. Nos. 6,012,335, 5,573,679, 5,889,872 and 5,888,845 mention that the microphone, which has concise structure with a mono-chip implementation. If people want to upgrade it to a bi-chip product, he has to consider how to construct its complex structure, and the time span of the process shall be expanded with higher techniques.

The traditional condenser microphone comprises a thin film and a fixed substrate, and then capacitor will be formed with a specified gap between this thin film and the fixed substrate. Whenever the outsider sound pressure makes the film vibration to generate the displacement variation under a polarized-voltage applied on that thin-film, the capacitance varied to generate a current signal, which is followed with the sound pressure rationally. However, this type's condenser microphone requires the external power to support the microphone response for sensing the sound pressure varying as the capacitance effects. Therefore it needs a higher polarized-voltage input to acquire a better sensitivity, but the elongation of thin film can't be uniformly distributed and the thin film is very sensitive to the environmental humidity.

SUMMARY OF THE INVENTION

Conclusively, the main purpose of this invention is led to solve the aforementioned defects. This invention provides a SMT-type structure of the silicon-based electret condenser microphone. The electret is made of the macromolecule material with a low-dielectric coefficient, and then coated the film with aforesaid material to let the microphone acquiring necessary electrical charges and reducing the harmonic distortion with its damping effects.

Another contribution of this invention is to provide a SMT-type structure of the silicon-based electret condenser microphone. Technically integrates the electret technology, silicon-based, MEMS and microphone to minimize its SMT-type structure, to lower its sensitivity of humidity effect, and not to need external high voltage bias.

In order to achieve that goal, this invention provides a SMT-type structure of the silicon-based electret condenser microphone. The structure comprises a composite diaphragm chip, a back-plate chip and the shell. Wherein the composite diaphragm chip contains a flat-type or a corrugated-type diaphragm (transferring sound pressure into mechanic vibration), the electrode-layer (offering a voltage flow-path), the electret-layer (providing electrical charges) and the segregation layer (forming a vibration space). That back-plate chip contains an electrode-layer (offering voltage flow-path), the perforated holes, a back-chamber (providing the air-damping), as well as the MOSFET (providing impedance matching). After assembling the diaphragm chip and the back-plate chip correspondingly, and then packing it with a shell to construct the electret Silicon-based condenser microphone. The electret is made of the macromolecule material with a low-dielectric coefficient, and then coated the bottom of the film with aforesaid material. After charging the electret layer, the electrical charges will be trapped and not be easily escaped from the electret. Therefore, it doesn't need extra voltage and the coating will against the moisture efficiently. The Silicon-based bi-diaphragm has the suitable strain to reduce the harmonic distortion of the microphone and the chamber to provide the air damping.

DETAILED DESCRIPTION OF THE PREFERRED EMBODIMENTS

The electrodes between the diaphragm and the back-plate are functioned as a capacitor that is specially designed for this invented silicon-based electret condenser microphone. Adding the electret located on the thin diaphragm, which is made of the polarized solid-dielectric material, therefore it doesn't need extra bias but gain enough power to work under the low-voltage environment. Moreover, the capacitor that is formed by the electrodes between the diaphragm and back-plate will change its value following with the relative diaphragm displacement variation as the incident sound pressure. There are two advantages; one is higher voltage response, another is lower humidity sensitivity without any extra bias. This silicon-based electret condenser microphone comprises a composite diaphragm chip 1, a back-plate chip 2 and a shell 3. Wherein the composite diaphragm chip 1 contains the flat-type or corrugated-type diaphragm 5

Figure 5:
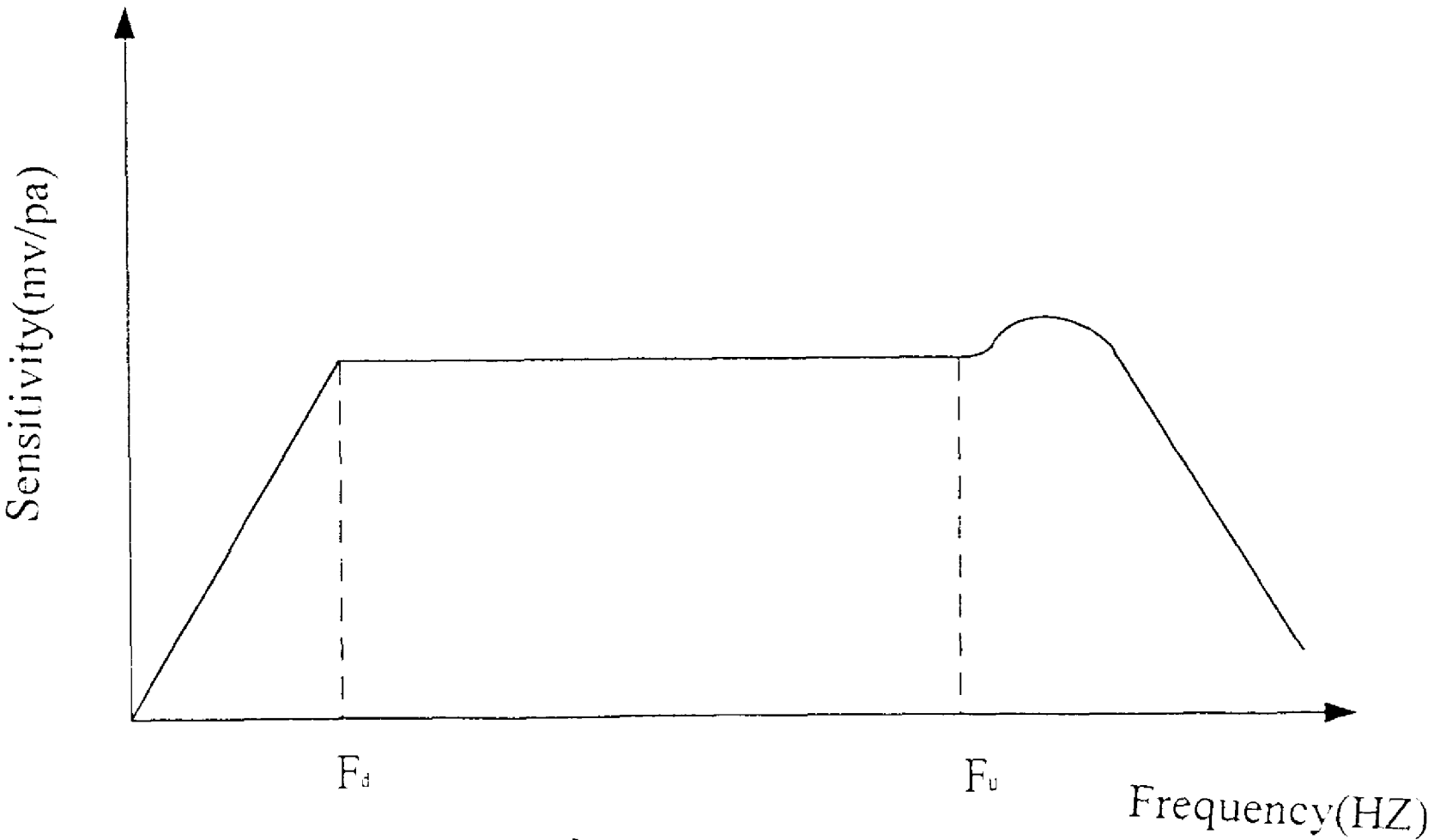
FIG. 5 show the frequency vs. sensitivity relationship chart of this invented silicon-based electret condenser microphone.

(transferring the sound signal into mechanic vibration), the first metal electrode layer 8 (forming the electrical path), the electret 9 (offering electric charges) and the spacer 10 (providing the vibration space). And the structure of the back-plate chip 2 comprises the second metal electrode layer 17 (offering electrical charges), the perforated holes 15, the back-chamber 16 (providing air-damping), the MOSFET 12 (providing impedance-matching), conductive pin hole 18 (providing the input and output of the source and drain of the MOSFET). Assembling that composite diaphragm chip 1 and the back-plate chip 2 into a face-to-face configuration, and then packing them with a shell to construct the silicon-based electret condenser microphone. Although this device is assembled with aforesaid mechanisms (the composite diaphragm chip 1, the back-plate chip 2 and the shell 3) to essentially function as a silicon-based electret condenser microphone, but microphone can only senses the signal with a frequency range from 20 Hz to 20 KHz, which is much lower than the pressure transducer's range. In order to avoid the microphone's signal distortion, the response curve has to be rearranged within the considerate frequency range. Simultaneously, the back-plate chip 2 must have back-chamber 16 to provide the sufficient air-damping character of the microphone structure. However, these specifications are commonly ignored to the pressure transducer. Since the microphone generally used for communication and its size has to be suitable for human ear, its function (efficiency and bandwidth) and design must be considered with human factors such as the frequency range (20 Hz~20 KHz) and the sensitivity. To the structure design, the sensing curve of the microphone must be concerned sincerely. The relationship chart of the sensitivity vs. frequency of this invented silicon-based electret condenser microphone is shown in FIG. 5. Wherein "S" is the microphone sensitivity, "$F_d$" is the lower frequency bound and "$F_u$" is the upper frequency bound. The lower the $F_d$ is or the higher the $F_u$ is, the better the response of the microphone performs and the lower the signal distortion is. Wherein $F_d$ is defined as $$F_d = \frac{1}{2\pi R_b(C_m + C_i + C_p)}$$

$R_b$: the external series resistance of the microphone
$C_m$: the capacitance of the electret condenser microphone
$C_i$: the external series capacitance of the microphone
$C_p$: the capacitance of the microphone packing (1) The $F_u$ is defined with the composite diaphragm chip as $$F_u = \frac{1}{k_o}\frac{1}{A_d}\sqrt{\frac{\sigma_d}{\rho_d}}$$

where $A_d$ is the diaphragm width, $\sigma_d$ is the diaphragm stress, $k_o$ is a constant, $\rho_d$ is the diaphragm density (2) The $F_u$ is defined with the back-plate chip as $$F_u = k\frac{ns_a^3\sigma_d h_d}{\eta_a \alpha_d^2}$$

where $S_e$ is the air-gap thickness between the diaphragm and the back-plate, $h_d$ is the diaphragm's thickness and $\eta_a$ is air-viscosity coefficient. However the relationship of the microphone sensitivity and chip structure is defined as $$S = R\frac{A_d^2}{\sigma_d h_d}\frac{s_e\sigma_e}{\varepsilon_0(s_e + \varepsilon_e s_a)}$$

where R is a ratio-constant (relevant to the perforated hole's density on the back-plate chip), $S_e$ is the diaphragm area, $\sigma_e$ is the charge density of the charged electret, $\in_e$ is the relative vacuum dielectric coefficient of the material between the electrodes, and $h_d$ is the diaphragm's thickness.

To reduce the stress of the composite diaphragm and increase the sensitivity of the microphone, the flat-type diaphragm can be changed to the corrugated-type diaphragm. The cross-section of the diaphragm is shown in FIG. 7, and the relationship between the sensitivity of the microphone and the corrugated-type diaphragm structure is shown below:

$$S_m = \frac{R_d^2}{4h_d\left(\sigma_0\frac{B_p}{2.83} + \frac{A_p}{4}E\frac{h_d^2}{R_d^2}\right)}$$

Where, is the equivalent radius of the diaphragm; is the thickness of the diaphragm; E is the Young's Modulus of the material of diaphragm; is the stress of the flat-type diaphragm (initial stress of the diaphragm layer without corrugation); while $$A_p = \frac{2(q+1)(q+3)}{3\left(1 - \frac{v^2}{q^2}\right)}$$

$$B_p = 32\frac{1-v^2}{q^2-9}\left[\frac{1}{6} - \frac{3-v}{(q-v)(q+3)}\right]$$

$$q^2 = \frac{S}{L}\left(1 + 1.5\frac{H^2}{h_d^2}\right)$$

where, v is Poisson's ratio, H is the depth of the corrugation, L is the corrugation spatial period, S is the corrugation arc length, and q is the corrugation profile factor.

Figure 1A:
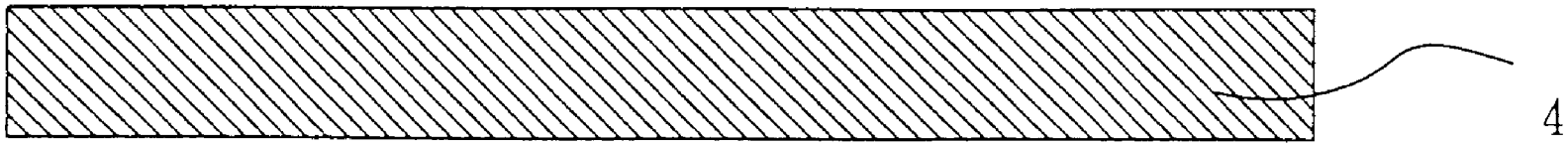
FIGS. 1A~1G show the structure profile of this invented flat-type composite diaphragm chip 1.
Figure 1B:
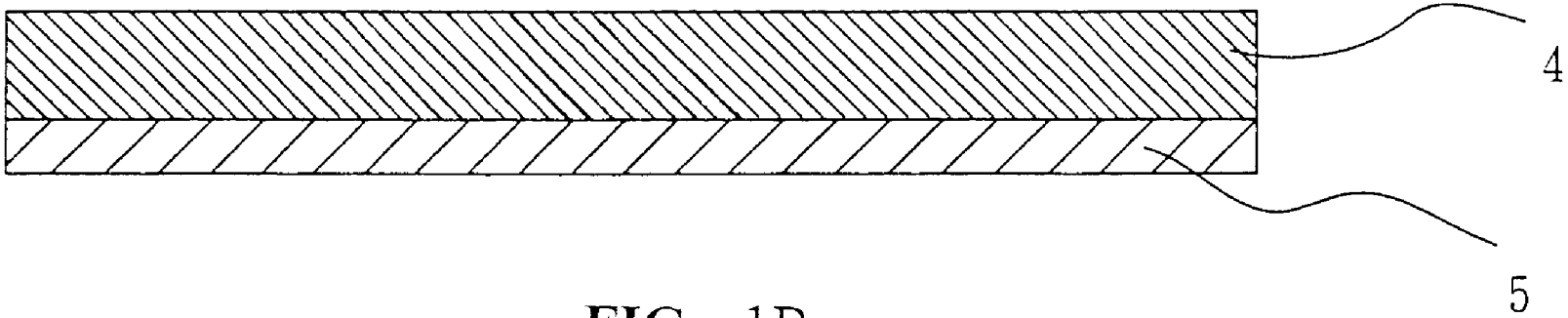
Figure 1C:
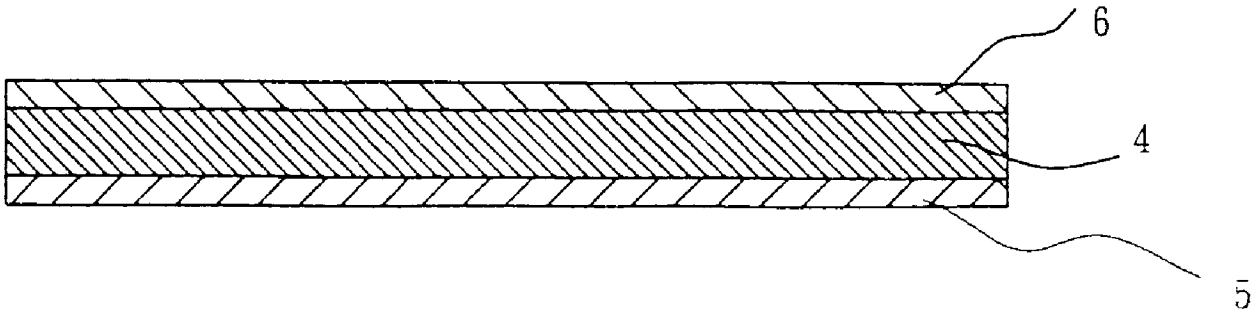
Figure 1D:
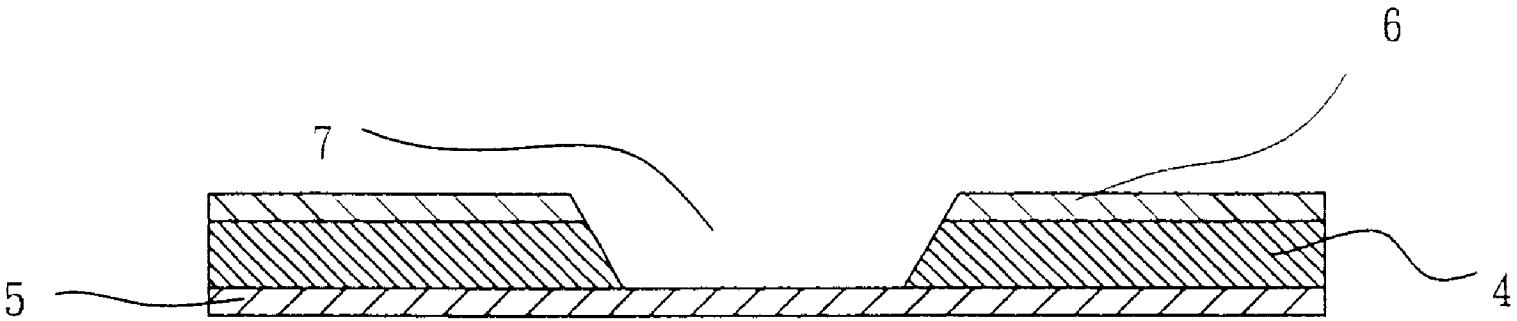
Figure 1E:
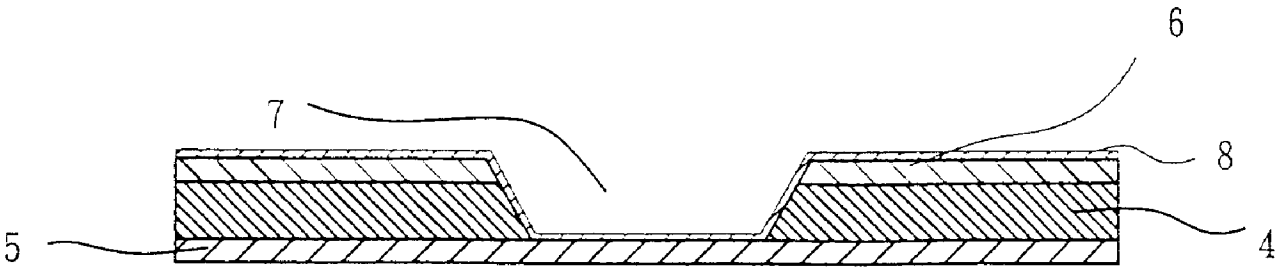
Figure 1F:
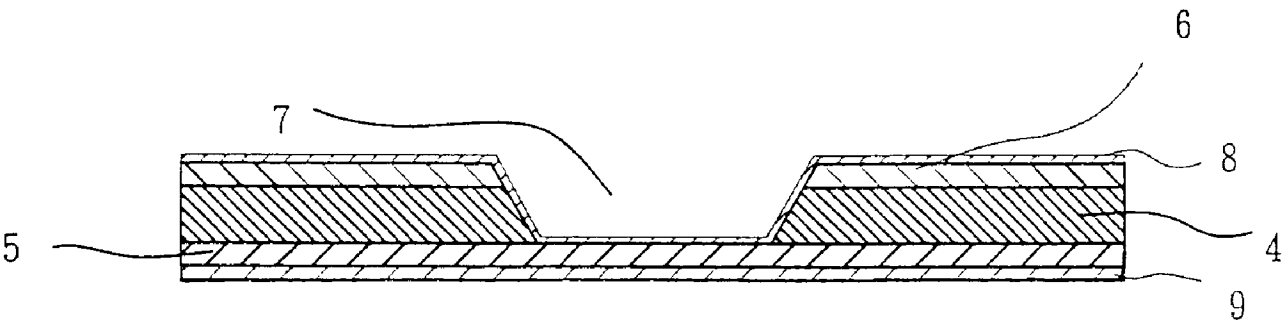
Figure 1G:
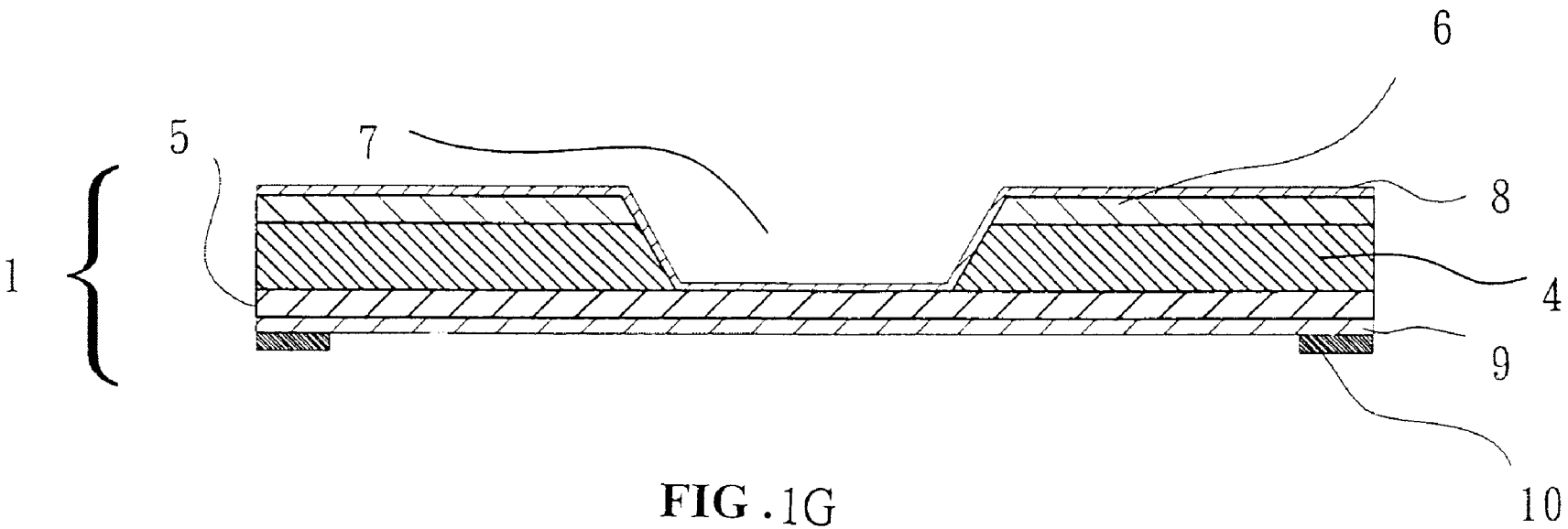
Figure 2A:
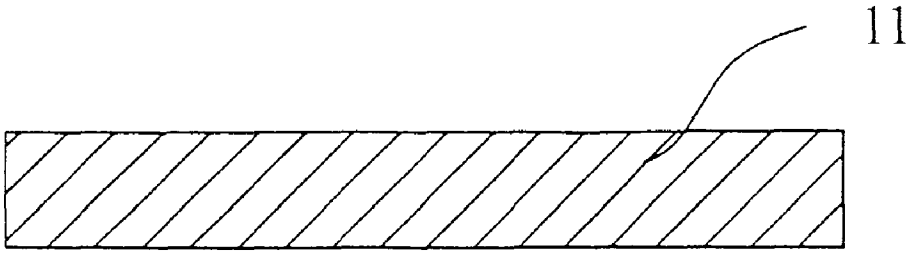
FIGS. 2A~2F show the structure profile of this invented back-plate chip 2.
Figure 2B:
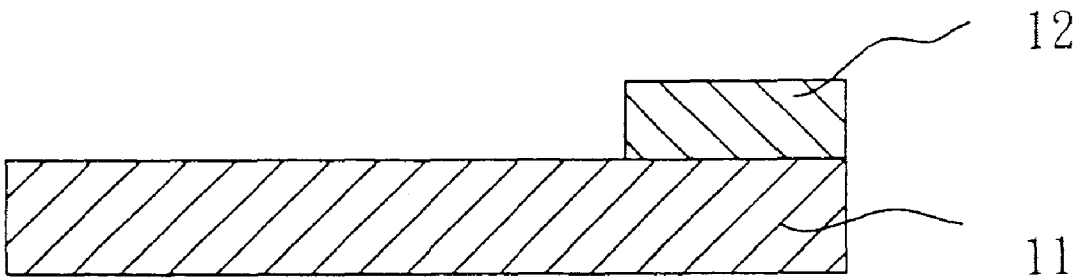
Figure 2C:
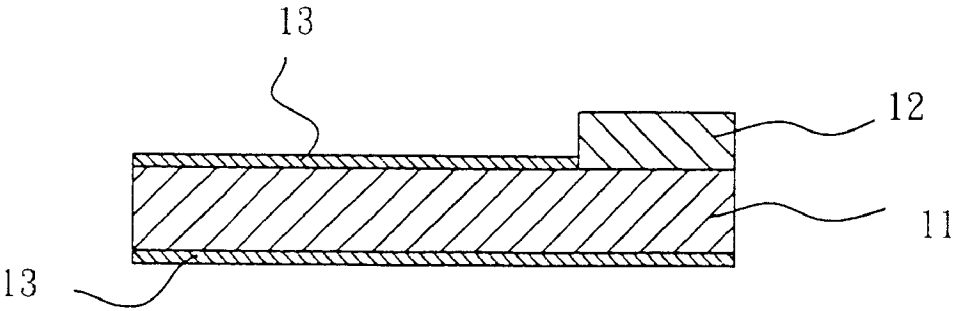
Figure 2D:
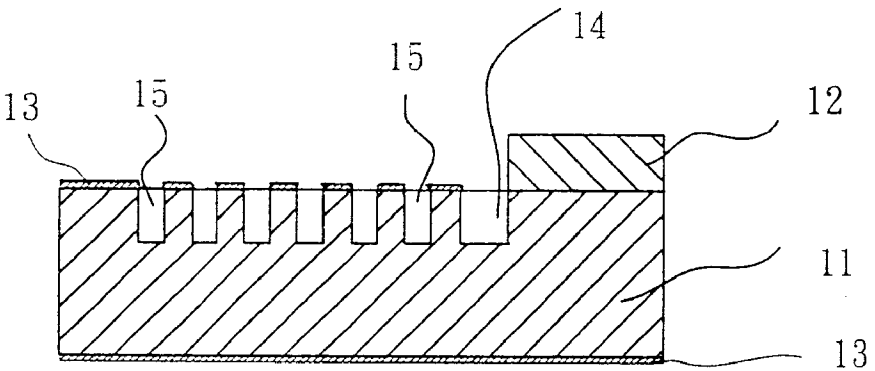
Figure 2E:
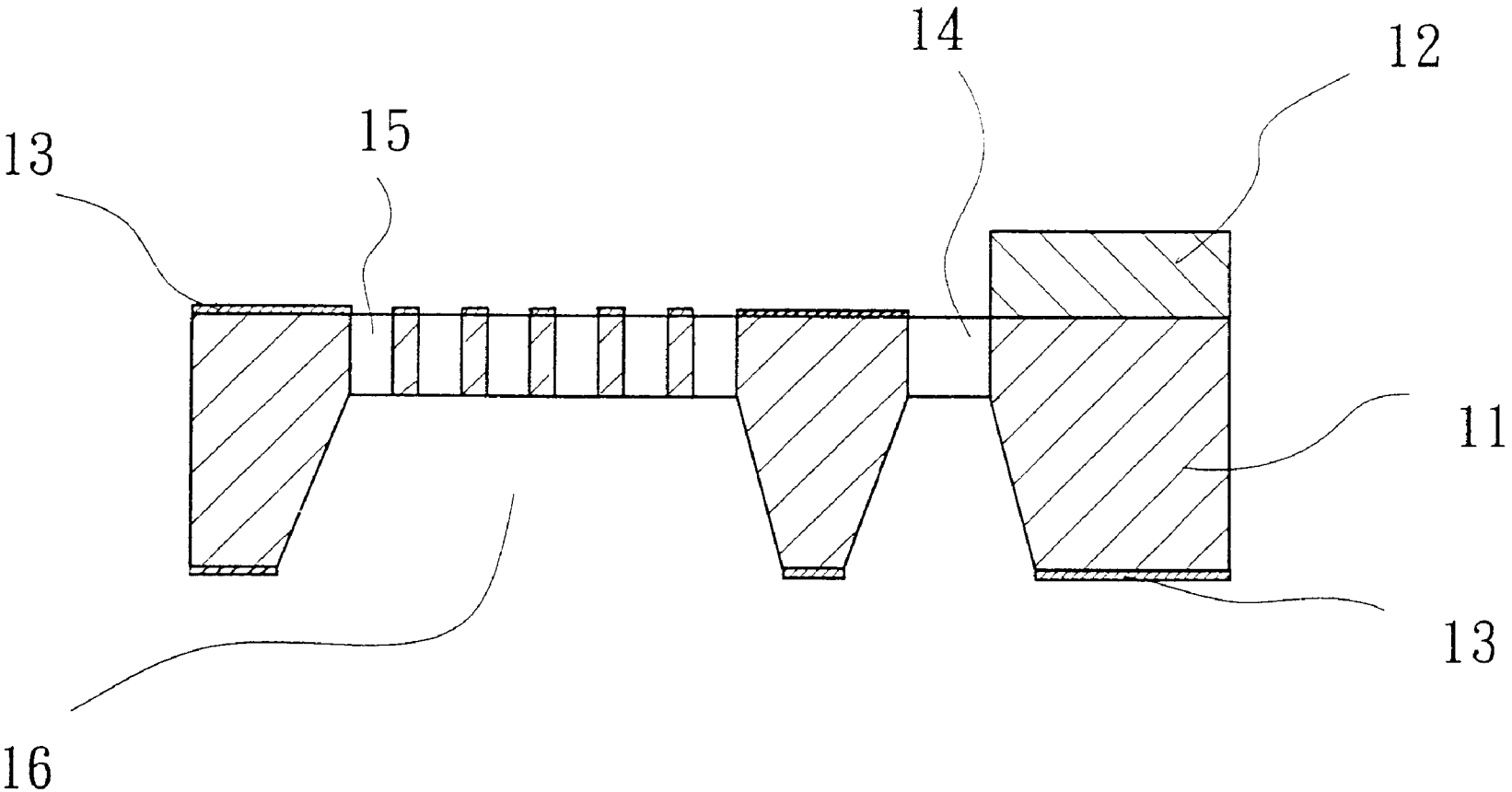
Figure 2F:
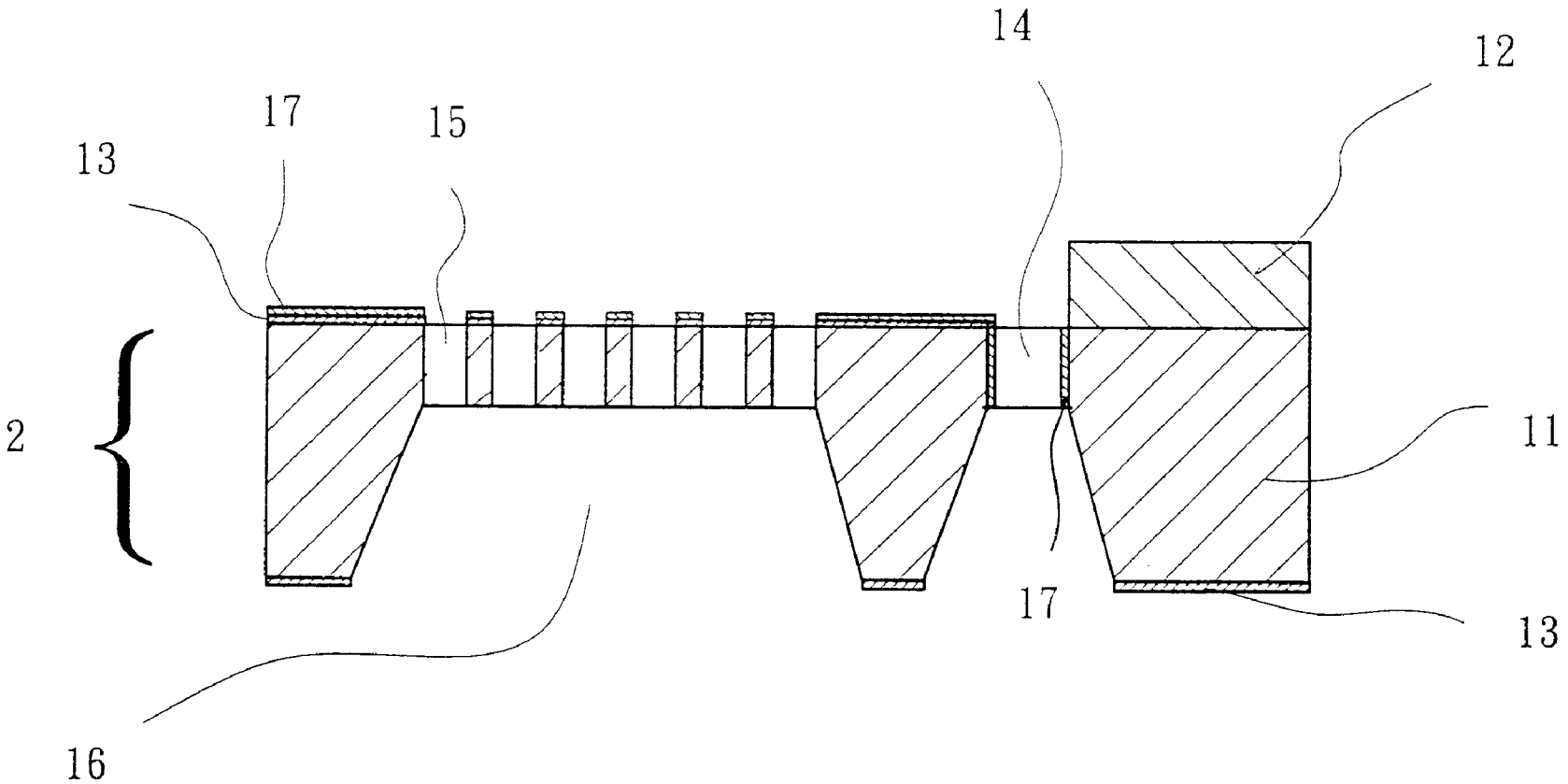
Figure 3:
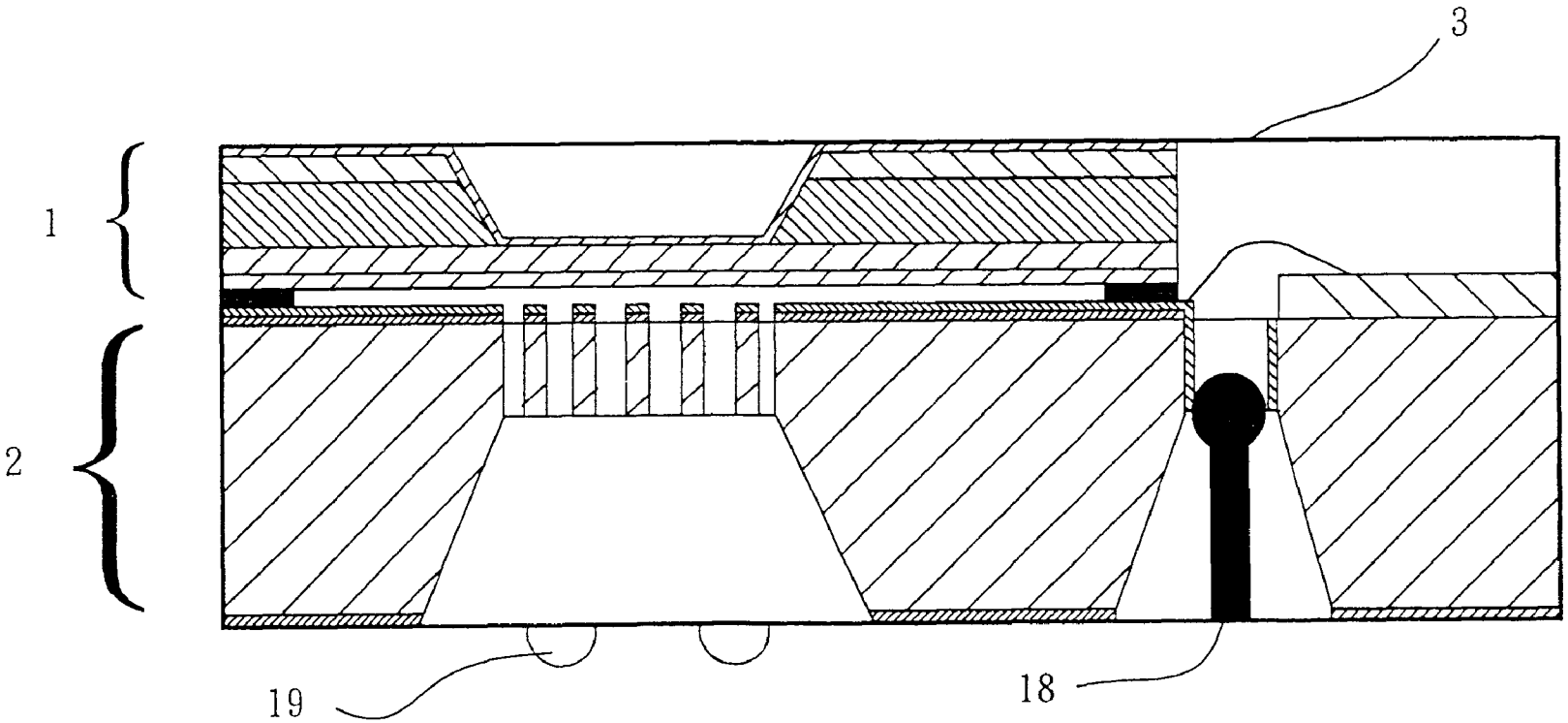
FIG. 3 shows the integrated configuration of this invented silicon-based electret condenser microphone.

Conclusively, this invention provides a SMT-type structure of the silicon-based electret condenser microphone that comprises a flat-type or corrugated-type composite diaphragm chip 1, a back-plate chip 2 and a shell 3. When the flat-type diaphragm is produced, the composite diaphragm chip 1 first comprises a substrate 4 as shown in FIG. 1A, and it is made of n-type or p-type Silicon chip with the single-faced polishing. Its thickness is 250 $\mu$m~550 $\mu$m and its impedance is 5 ohm-cm~25 ohm-cm; when the flat-type diaphragm is produced, firstly the structure of the composite diaphragm chip 1 as shown in FIG. 1A comprises a flat-type substrate 4, which can adopt n-type or p-type silicon chip with the singled faced polishing, exposed, lithographic and etching processes to form a first corrugated-type substrate 4 as shown in FIG. 2. The flat-type diaphragm 5 is formed on the bottom of the first substrate 4, which is shown in FIG. 1B, and the material of the flat-type or corrugated-type diaphragm 5 can be chosen from SixN4 or Si3N4 and SiO2 with a low residue stress. The diaphragm 5 area range is 0.5 mm2~2 mm2 and thickness range is 0.5 $\mu$m~2 $\mu$m. As shown in FIG. 1C, the Nitride-Silicon layer 6 is formed by using LPCVD to deposit Nitride-Silicon on the wafer of the top-face of the first substrate 4. And then to form the concave slot 7 on the first substrate 4 and the first Silicon-Nitrate layer 6, which is shown in FIG. 1D. Moreover, the first electrode layer 8 is made of Gold or Aluminum and is located on the Nitride-Silicon layer 6 and the concave slot 7, which shown in FIG. 1E. Wherein the thickness of the first electrode layer 8 is 500 Å~2000 Å. In FIG. 1F, the electret layer 9 is formed on the bottom-face of the flat-type or corrugated-type composite diaphragm 5, and is made of the Fluorite polymer (such as PTFE, Teflon-FEP, and Teflon-PFA) and BCB (Benzocyclobutene) with a low dielectric coefficient. The thickness range of the electret layer 9 is 0.8 μm~5 μm. After coating the aforesaid material on the diaphragm bottom-face and applying the corona ion-beam charge to permanently maintain the electric charges reserved in the electret layer, then it'll avoid the electric charges escaping. In FIG. 1G, the spacer 10 is formed between the two terminals of the electret bottom-face, which is located between the composite diaphragm chip and the back-plate chip. The spacer is made of a higher insulation polyamide PI and its thickness is 3 μm~10 μm. Going through the procedures, the composite diaphragm chip is well implemented. To consider the structure of the back-plate chip 2, wherein the second substrate 11 is made of the n-type or p-type Silicon-based double-face polishing chip, as shown in FIG. 2A. The thickness of the back-plate is 250 μm~550 μm and the resistance is 5 ohm-cm~25 ohm-cm. The MOSFET 12 is formed on the one side of the top-face of the second substrate 11, which is shown in FIG. 2B. The first Nitride-Silicon deposit layers 13 are formed on both top-face and bottom-face of the second substrate 11, which is shown in FIG. 2C. The cannelure 14 is formed on the top-face of the second substrate 11 and one side of the MOSFET 12, which is shown in FIG. 2D. Moreover, the perforated holes 15 are formed on a suitable position of the top-face of the second substrate 11, and the dimension of the perforate hole 15 is 10 μm~100 μm with a thickness of 10 μm~200 μm and a density of 16/mm2~900/mm2. The back-chamber 16 is formed on the bottom-face of the second substrate 2, as shown in FIG. 2E, and the volume of the back-chamber 16 of the back-plate chip 2 is 0.2 mm3~1 mm3. The second electrode layer 17 is formed on the top-face of the back-plate chip 2, as shown in FIG. 2F. The second electrode layer 17 can be made of either Gold or Aluminum with a back-plate thickness of 500 Å~2000 Å. Conclusively, the back-plate thickness of the second back-plate chip 2 is 10 μm~200 μm with an area of 0.5 $mm^2$~2 $mm^2$. Assembling the composite diaphragm chip 1 and the back-plate chip 2 in a face-to-face configuration and packing with the shell 3, and then the silicon-based electret condenser microphone is implemented after the wiring up the conducting pin 18 and pin 19. The integrated configuration of the SMT-type silicon-based electret condenser microphone is shown in FIG, 3.

The implement procedure of this silicon-based electret condenser microphone, which comprises a composite diaphragm chip 1 and a back-plate chip 2, is described as following:

1) The composite diaphragm chip 1:

a) Firstly provides the first substrate 4 on the composite diaphragm chip 1.

b) Forms the flat-type or corrugated-type composite diaphragm 5 on the first substrate 4 by using the depositing method.

c) Forms the Nitride-Silicon layer 6 on the top-face of the first substrate 4.

d) Forms the concave slot 7 on the first substrate 4 and the Nitride-Silicon layer 6, and the concave slot 7 is made by using the etching method.

e) Forms the first electrode layer 8 on the Nitride-Silicon layer 6 and the concave slot 7 by using the sputtering method.

f) Forms the electret layer 9 on the bottom-face of the flat-type or corrugated-type composite diaphragm 5 by using the coating method, and charging the electret layer 9 simultaneously.

g) Forms the insulation spacer 10 on the two terminals of the electret layer 9 by using the photo-mask and the micro-holography method.

h) Completion of the above procedures, the composite diaphragm chip 1 is well done.

2) The back-plate chip 2:

a) Provides the second substrate 11 and forms the MOSFET 12 on the one side of the top-face of the second substrate 11 by using the semiconductor manufacturing method.

b) Forms the second Nitride-Silicon deposit layer 13 on both faces of the second substrate 11 by using the depositing method.

c) Forms the cannelure 14 with a suitable depth on the top-face of the second substrate 11 and one side of the MOSFET 12.

d) Forms several perforated holes 15 on a suitable zone of the top-face of the second substrate 11 and the back-chamber 16 on the bottom-face of the second substrate 11 by using the dry-etching or the wet-etching method.

e) Forms the second electrode layer 17 on the top-face of the back-plate.

f) Completion of the above procedures, the back-plate chip 2 is well done.

Figure 4:
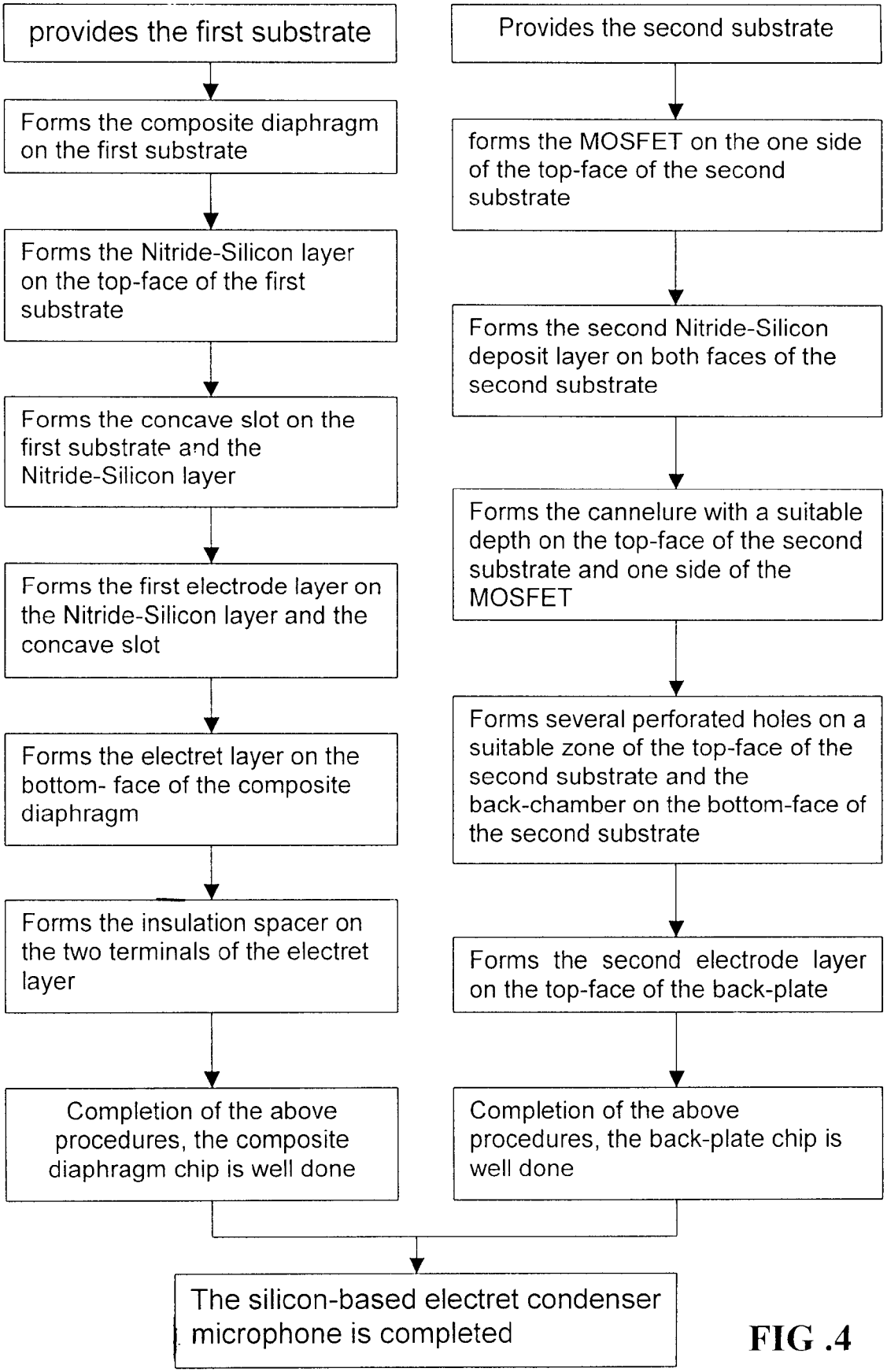
FIG. 4 shows the implementation flowchart of this invented silicon-based electret condenser microphone.

After it is packed with a shell, then this silicon-based electret condenser microphone is completed. FIG. 4 is the implementation flowchart of this silicon-based electret condenser microphone.

What is claimed is:

1. A structure of the silicon-based electret condenser microphone which comprise of:

(1) flat-type or corrugated-type composite diaphragm-chip, which comprises a first substrate;

a flat-type or corrugated-type diaphragm, formed on the bottom of the first substrate;

a first Nitride-Silicon layer, formed on the top of the first substrate;

a concave slot, formed on the first substrate and the first Nitride-Silicon layer;

a first electrode layer, formed on the first Nitride-Silicon layer and the top of the concave slot;

a electret layer, formed on the bottom of the diaphragm;

a spacer, formed on the both terminal zones of the electret bottom;

(2) back-plate chip, which comprises a second substrate;

a MOSFET, formed on the one side of the second substrate top;

two deposit layers, formed on the top and the bottom surfaces of the second substrate;

a cannelure, formed on the top-face of the second substrate and the one side of the MOSFET;

several Perforated holes, formed on a suitable area of the second substrate;

a back-chamber, formed on the bottom-face of the second substrate perforated holes and is an up-toward concave slot;

a second electrode layer, formed on the top-face of the back-plate chip;

a pair of conductive pin hole, formed on the top-face the back-plate chip;

(3) a shell, which is used to pack the composite diaphragm chip and the back-plate chip together to form a Silicon-based electret condenser microphone.

2. A structure of the silicon-based electret condenser microphone of claim 1, wherein the resistance range of the first substrate and the second substrate is 5 ohm-cm~25 ohm-cm and the thickness range is 250 $\mu$m~550 $\mu$m.

3. A structure of the silicon-based electret condenser microphone of claim 1, wherein the diaphragm area range of the composite diaphragm-chip is 0.5 $mm^2$~2.0 $mm^2$ and the thickness range is from 0.5 $\mu$m to 2.0 $\mu$m.

4. A structure of the silicon-based electret condenser microphone of claim 1, wherein the electret thickness range of the composite diaphragm-chip is 0.8 $\mu$m~5.0 $\mu$m.

5. A structure of the silicon-based electret condenser microphone of claim 1, wherein the spacer thickness range of the composite diaphragm-chip is 3 $\mu$m~10 $\mu$m.

6. A structure of the silicon-based electret condenser microphone of claim 1, wherein the back-plate's thickness range of the back-plate chip is 10 $\mu$m~200 $\mu$m and its area range is from 0.5 $mm^2$ to 2 $mm^2$.

7. A structure of the silicon-based electret condenser microphone of claim 1, wherein the back-chamber volume range of the back-plate chip is 0.2 $mm^3$~1 $mm^3$.

8. A structure of the silicon-based electret condenser microphone of claim 1, wherein the perforated hole-size range of the back-plate chip is 10 $\mu$m~100 $\mu$m, its thickness range is from 10 $\mu$m to 200 $\mu$m and the hole-density is 16/$mm^2$~900/$mm^2$.

9. A structure of the silicon-based electret condenser microphone of claim 1, wherein the thickness of the first electrode layer and the second electrode layer are 500 Å~2000 Å.

10. A structure of the silicon-based electret condenser microphone of claim 1, wherein the first substrate is the n-type or p-type single-faced polishing but the second substrate is the n-type or p-type double-faced polishing of the composite diaphragm chip.

11. A structure of the silicon-based electret condenser microphone of claim 1, wherein the diaphragm of the composite diaphragm chip can be either $Si_xN_4$ or $Si_3N_4$ and $SiO_2$ which is made of the composite diaphragm with a low residue stress.

12. A structure of the silicon-based electret condenser microphone of claim 1, wherein the first electrode layer and the second electrode layer of the composite diaphragm chip are made of Gold or Aluminum.

13. A structure of the silicon-based electret condenser microphone of claim 1, wherein the electret of the composite diaphragm-chip is chosen from the material with a low dielectric coefficient.

14. A structure of the silicon-based electret condenser microphone of claim 13, wherein the electret of the composite diaphragm chip is chosen from one of PTFE, Teflon-FEP, Teflon-PAF and BCB.

15. A structure of the silicon-based electret condenser microphone of claim 1, wherein the depth of the corrugation of the substrate of the corrugated-type diaphragm is 1 $\mu$m~20 $\mu$m, the corrugation spatial period is 2 $\mu$m~50 $\mu$m, and the corrugation number is 1~10 circle.

16. A structure of the silicone-based electret condenser microphone of claim 1, further comprising two conductive pin holes for the input and output of the source and the drain of the MOSFET.

17. A structure of the silicone-based electret condenser microphone of claim 1, wherein said first electrode layer is made of a material selected from the collection of gold and aluminum deposited on said first substrate and coupled to a source and a drain of the MOSFET by the external casing through the conductive pins.

18. A structure of the silicone-based electret condenser microphone of claim 1, wherein said second electrode layer is made of a material selected from the collection of gold and aluminum deposited on said second substrate and coupled to a gate of the MOSFET by the conductive wire.

19. A structure of the silicone-based electret condenser microphone of claim 1, wherein the bias voltage source is coupled to the conductive pins and then to the drain and source of the MOSFET.

* * * * *